US009756990B2

(12) United States Patent
Cassiday

(10) Patent No.: US 9,756,990 B2
(45) Date of Patent: Sep. 12, 2017

(54) WASHING DEVICE

(71) Applicant: PARIS PRESENTS INCORPORATED, Gurnee, IL (US)

(72) Inventor: Elizabeth Cassiday, Chicago, IL (US)

(73) Assignee: Paris Presents Incorporated, Gurnee, IL (US)

( * ) Notice: Subject to any disclaimer, the term of this patent is extended or adjusted under 35 U.S.C. 154(b) by 140 days.

(21) Appl. No.: 14/257,642

(22) Filed: Apr. 21, 2014

(65) Prior Publication Data

US 2015/0216371 A1 Aug. 6, 2015

Related U.S. Application Data

(60) Provisional application No. 61/935,955, filed on Feb. 5, 2014.

(51) Int. Cl.
*A47K 7/03* (2006.01)

(52) U.S. Cl.
CPC ..... *A47K 7/03* (2013.01); *Y10T 29/49826* (2015.01); *Y10T 29/49838* (2015.01)

(58) Field of Classification Search
CPC ... A46B 1/00; A47K 7/02; A47K 7/03; A47K 5/04; A47K 5/05; A47K 5/14
USPC ..... 15/110
See application file for complete search history.

(56) References Cited

U.S. PATENT DOCUMENTS 4,479,277 A * 10/1984 Gilman ..... A46B 9/02 15/106
4,480,351 A * 11/1984 Koffler ..... A46B 1/00 15/106
4,618,443 A * 10/1986 Jude ..... A47K 7/03 15/104.94
5,035,468 A * 7/1991 Brown ..... A46B 11/001 300/21
6,735,808 B2 * 5/2004 Chen ..... A47K 7/028 15/110
7,008,132 B1 * 3/2006 Phua ..... A46B 11/001 401/125
8,926,205 B1 * 1/2015 Allen ..... A47K 5/05 401/88
2011/0302737 A1 12/2011 Bingaman
2013/0247317 A1 * 9/2013 Williams ..... A47K 7/03 15/118
2013/0276251 A1 * 10/2013 Guynn ..... A61B 19/36 15/104.94

* cited by examiner

*Primary Examiner* — Jennifer C Chiang
*Assistant Examiner* — Bradley Oliver
(74) *Attorney, Agent, or Firm* — The Ollila Law Group LLC

(57) ABSTRACT

The present application provides a washing device (100) and a method for fabricating the same. The washing device (100) includes a base washing member (108), an attachment washing member (102), and a coupling element (508) coupling the attachment washing member (102) to the base washing member (108). The attachment washing member (102) further includes a bracket (106, 502) and a washing surface (104).

15 Claims, 5 Drawing Sheets

WASHING DEVICE

CROSS-REFERENCE TO RELATED APPLICATION

This application claims priority from U.S. Provisional Patent Application No. 61/935,955, filed Feb. 5, 2014, entitled "Washing Device," the contents of which are incorporated herein by reference.

TECHNICAL FIELD

The present application relates to, washing devices, and more particularly, to a washing device including one or more base members and one or more attachment members.

BACKGROUND OF THE APPLICATION

Washing and cleaning devices are generally known and are sold in a wide variety of configurations. One particular type of a washing device comprises a body-washing device designed to aid in the cleaning of a body of a person. Body-washing devices typically comprise one or more washing members such as a sponge, a loofah, exfoliating fabric, such as netting, cloths, a textured surface, etc. In some devices, the washing members are also configured to hold or retain an amount of a cleaning agent such as soap, body wash, lotion, etc. In some devices, a washing member may be fabricated from soap. A user can manipulate the washing device to contact the one or more washing members with the user's body.

One problem associated with typical washing devices is that a user may wish to use more than one of them, and therefore the user must manage multiple washing devices in the shower. One problem associated with multiple washing devices is storage between uses. Washing devices are typically stored on the floor of a shower or held in a rack or support within the shower, which can create clutter. This is not ideal, however, because the washing device may not properly dry between uses, resulting in mold and bacteria, which may shorten the useable life span of the washing device. Accessing the multiple washing devices can also be problematic. Furthermore, having multiple washing devices in a shower or bath can create a hazard for the user who may become entangled in the devices or slip and fall.

Therefore, a user typically must choose between the simplicity of purchasing a single washing device that is designed for a limited application or purchasing and managing multiple washing devices with different configurations.

The present application overcomes these and other problems and an advance in the art is achieved. The present application provides a single washing device that incorporates the advantages of multiple washing devices into a simple, manageable configuration.

SUMMARY OF THE APPLICATION

A washing device is provided according to an embodiment of the application. The washing device includes a base washing member, an attachment washing member, and a coupling element. The attachment washing member includes a bracket and a washing surface. The coupling element couples the attachment washing member to the base washing member.

A method for forming a washing device including a base washing member and an attachment washing member is provided. The attachment washing member includes a bracket and a washing surface. The method comprises the steps of forming the bracket, forming the washing surface, coupling the bracket and the washing surface, and coupling the base washing member to the attachment washing member.

ASPECTS OF THE APPLICATION

Preferably, the bracket includes a lip around a perimeter of the bracket.

Preferably, the bracket and the washing surface are each formed via an injection molding process.

Preferably, the bracket and the washing surface are formed via a two-part injection molding process.

Preferably, the bracket is formed from a first plastic and the washing surface is formed from a second plastic, the second plastic being softer than the first plastic.

Preferably, the bracket is formed from a high impact polystyrene.

Preferably, bracket is formed from a thermoplastic rubber.

Preferably, the bracket and the washing surface are irremovably affixed.

Preferably, the coupling element couples the attachment washing member to the base washing member using the bracket.

Preferably, the bracket includes one or more eyelets to which the coupling element threads.

DETAILED DESCRIPTION OF THE APPLICATION

FIGS. 1-7 and the following description depict specific examples to teach those skilled in the art how to make and use the best mode of the application. For the purpose of teaching inventive principles, some conventional aspects have been simplified or omitted. Those skilled in the art will appreciate variations from these examples that fall within the scope of the application. Those skilled in the art will appreciate that the features described below can be combined in various ways to form multiple variations of the application. As a result, the application is not limited to the specific examples described below, but only by the claims and their equivalents.

Figure 1:
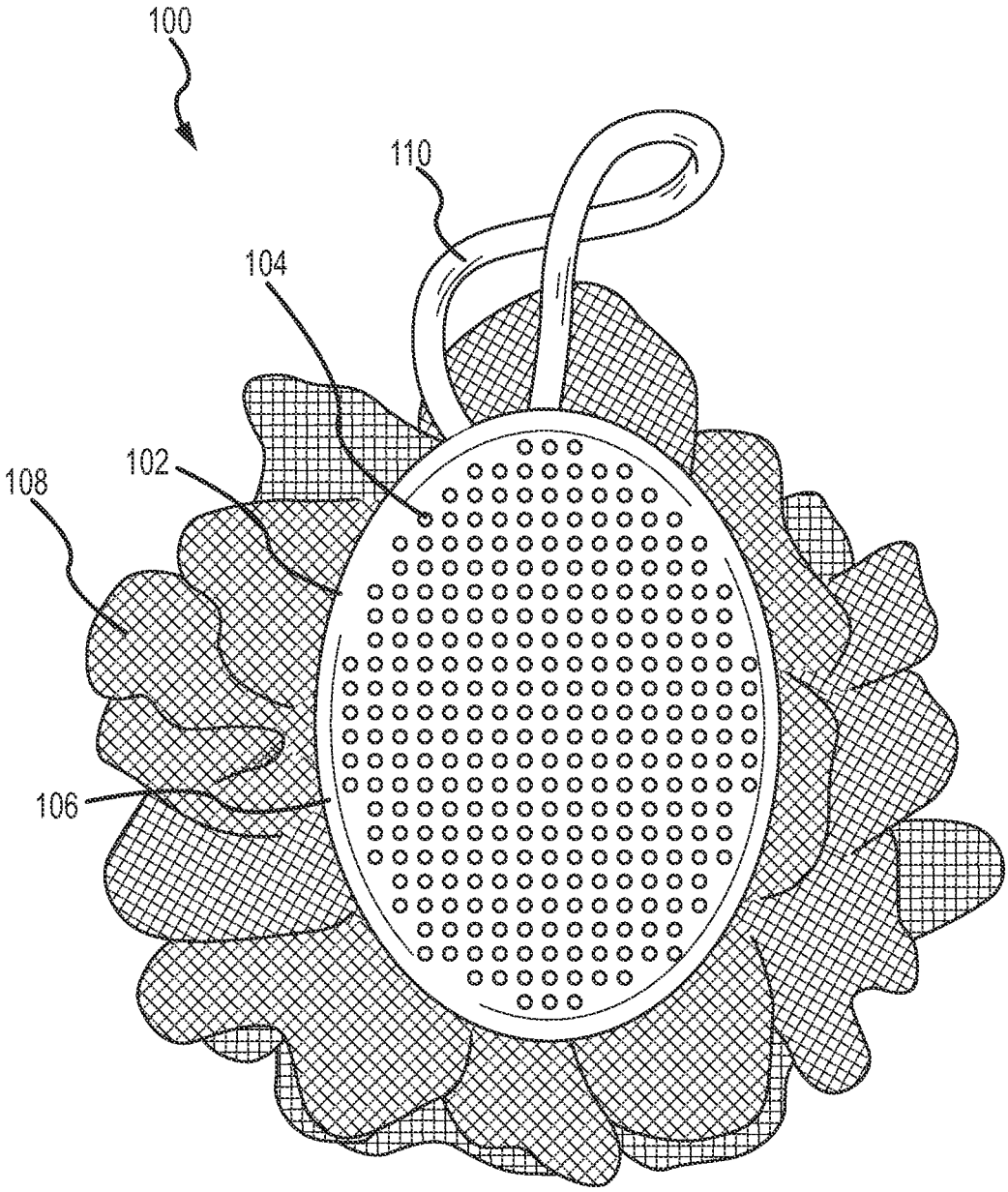
FIG. 1 depicts a frontal view of a washing device according to an embodiment of the application.

FIG. 1 depicts a frontal view of a washing device 100 according to an embodiment of the application. Washing device 100 includes scrublet attachment 102, a base scrubber 108, and a handle 110. The scrublet attachment 102 includes a scrubbing surface 104 and a bracket 106. The washing device 100 may be provided to wash a body of a human as is generally known for purposes of health and hygiene. According to another embodiment of the application, the washing device 100 may be provided to wash or clean a different surface.

Base scrubber 108 forms a base washing member for washing device 100. Base scrubber 108 may be formed from a sponge, a loofah, exfoliating fabric, such as netting, cloths, mesh, etc. The particular material used to form the base scrubber 108 is not important for purposes of the present application and should in no way limit the scope of the present application. Further, the particular material used for the base scrubber 108 may vary depending on a desired roughness and/or intended use. According to some embodiments of the application, the base scrubber 108 may be formed from different materials having differing degrees of roughness. The base scrubber 108 may be used to clean a specific portion of a body. According to an embodiment of the application, the base scrubber 108 may be provided to wash and/or exfoliate a user's skin. The base scrubber 108 may be configured to temporarily retain soap, body wash, and/or lotion to be applied to a user's body during use. In the embodiment of washing device 100, the base scrubber is formed from a gathered, plastic netting to fill an approximately semi-spherical three-dimensional space. The plastic netting may be gathered and secured in any manner, for example the plastic netting may be secured with cord or zip ties.

According to an embodiment of the application, the washing device 100 also includes a scrublet attachment 102. Scrublet attachment 102 may be an attachment washing member. In the embodiment of washing device 100, the face of scrublet attachment 102 is substantially oval-shaped. In other embodiments, scrublet attachment 102 may be any shape. Scrublet attachment 102 includes scrubbing surface 104, which is coupled to bracket 106. Scrubbing surface 104 may be a washing surface. Scrubbing surface 104 and bracket 106 may be coupled to one another using known methods, such as with mechanical fasteners, adhesives, etc. The scrublet attachment 102 may be formed from plastic, wood, metal, or any other hard substance. In embodiments, scrublet attachment 102 may be formed from soap. Scrubbing surface 104 may have any degree of roughness. Scrubbing surface 104 may be designed to clean a specific portion of a body. According to an embodiment of the application, the scrubbing surface 104 may be provided to wash and/or exfoliate a user's skin. The scrubbing surface 104 may be configured to temporarily retain soap, body wash, and/or lotion to be applied to a user's body during use.

Washing device 100 further includes a handle 110. In the embodiment of washing device 100, the handle 110 is a cord or a rope formed in a loop. Handle 110 allows a user to conveniently grasp and store washing device 100.

Figure 2:
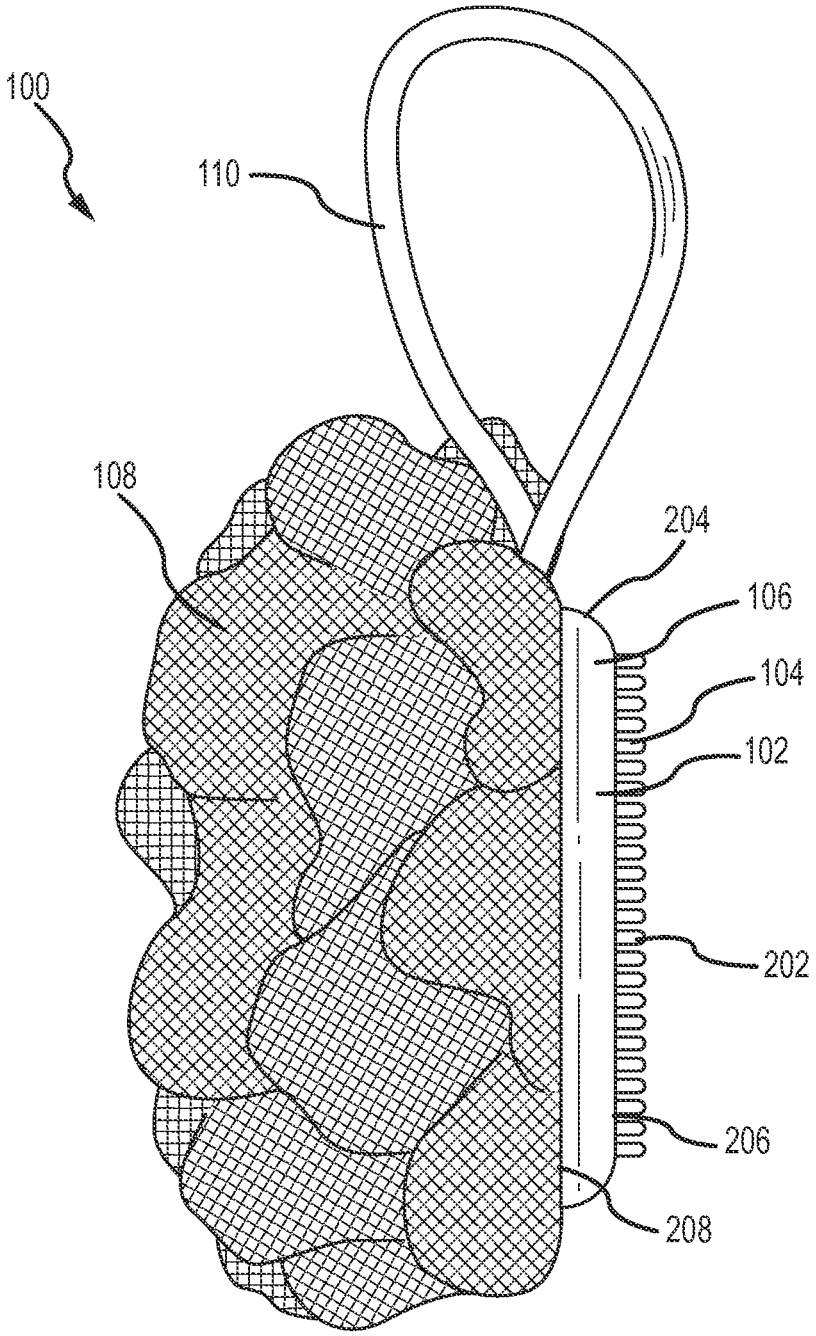
FIG. 2 depicts a side view of a washing device according to an embodiment of the application.

FIG. 2 depicts a side view of a washing device according to an embodiment of the application. In the perspective FIG. 2, it may be seen that washing device 100 further includes fingers 202, an arc-shaped rim 204, a first face 206, and a second face 208.

Scrubbing attachment 102 includes first face 206 and second face 208. First face 206 and second face 208 are substantially flat. Second face 208 is coupled to base scrubber 108. First face 206 includes a grid of fingers 202. Fingers 202 of scrubbing surface 104 may be seen extending away from first face 206 in a perpendicular direction. In the embodiment of washing device 100, fingers 202 comprise short, thin plastic fingers that may scrub and exfoliate a surface being cleansed. In embodiments, fingers 202 may be made from a plastic such as a rubberized plastic. Fingers 202 may be formed in any size and or shape to accommodate any fabrication material and/or washing purpose.

The second face 208 may include features to facilitate attachment between scrublet attachment 102 and base scrubber 108. In the embodiment of washing device 100, it may be seen that the surface area of second face 208 is slightly larger than the surface area of first face 206. Scrublet attachment 102 is shaped to include an arc-shaped rim 204 between differently sized first and second faces 206 and 208. Rim 204 may substantially surround the first and second faces 206 and 208.

Figure 3:
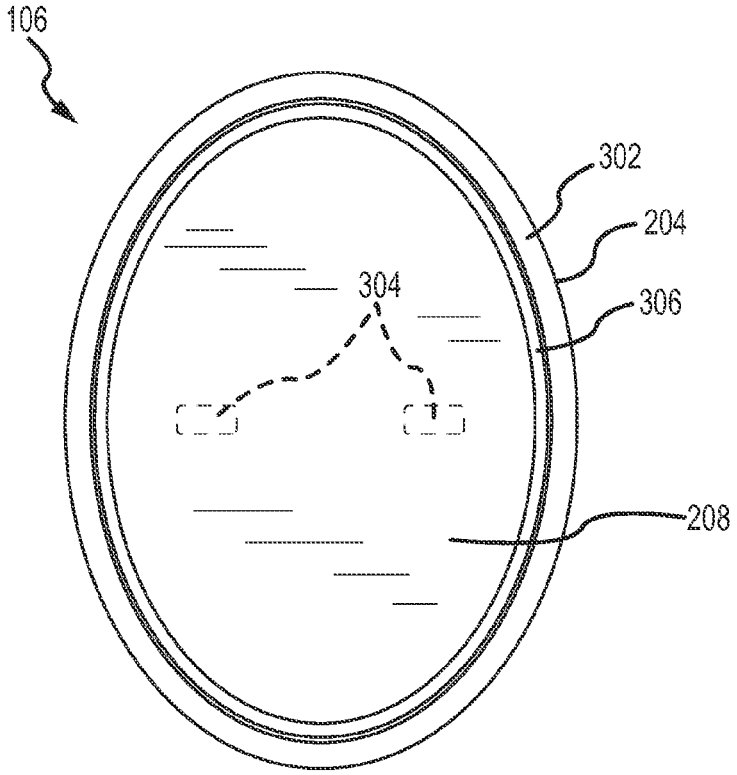
FIG. 3 depicts a top view of a bracket according to an embodiment of the application.
Figure 4:
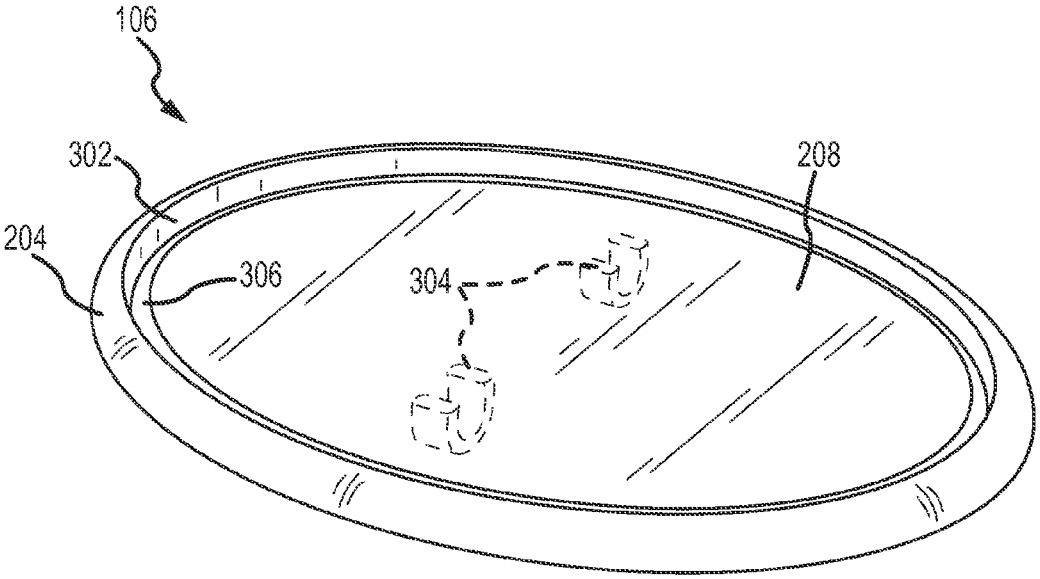
FIG. 4 depicts a perspective view of a bracket according to an embodiment of the application.

FIGS. 3 and 4 depict an example bracket of a scrublet attachment according to an embodiment of the application. FIG. 3 depicts a top view and FIG. 4 depicts a perspective view of bracket 106. FIG. 3 includes rim 204, second face 208, a lip 302, eyelets 304, and an inner recess 306.

Second face 208 is surrounded by lip 302, which forms a framed base into which scrubbing surface 104 may be coupled (not shown). The inside portion of lip 302, inner recess 306, provides a seat into which a scrubbing surface may be positioned. The outside portion of lip 302, rim 204, may remain exposed or be covered when scrubbing surface 104 is coupled to bracket 106.

In embodiments, bracket 106 may be formed in a thermoplastic via an injection molding process. For example, bracket 106 may be formed in a polyethylene, a polypropylene, a polystyrene, a polyvinyl chloride, a fluoropolymer plastic, or any other plastic known to those of skill in the art. In an embodiment, a high impact polystyrene plastic may be used.

In the embodiment of FIGS. 3 and 4, bracket 104 includes two eyelets 304, which are formed on the second face of bracket 106. Eyelets 304 provide an anchor for a coupling member (not shown) to attach to. For example, a coupling member may affix bracket 106 to base scrubber 108.

Figure 5:
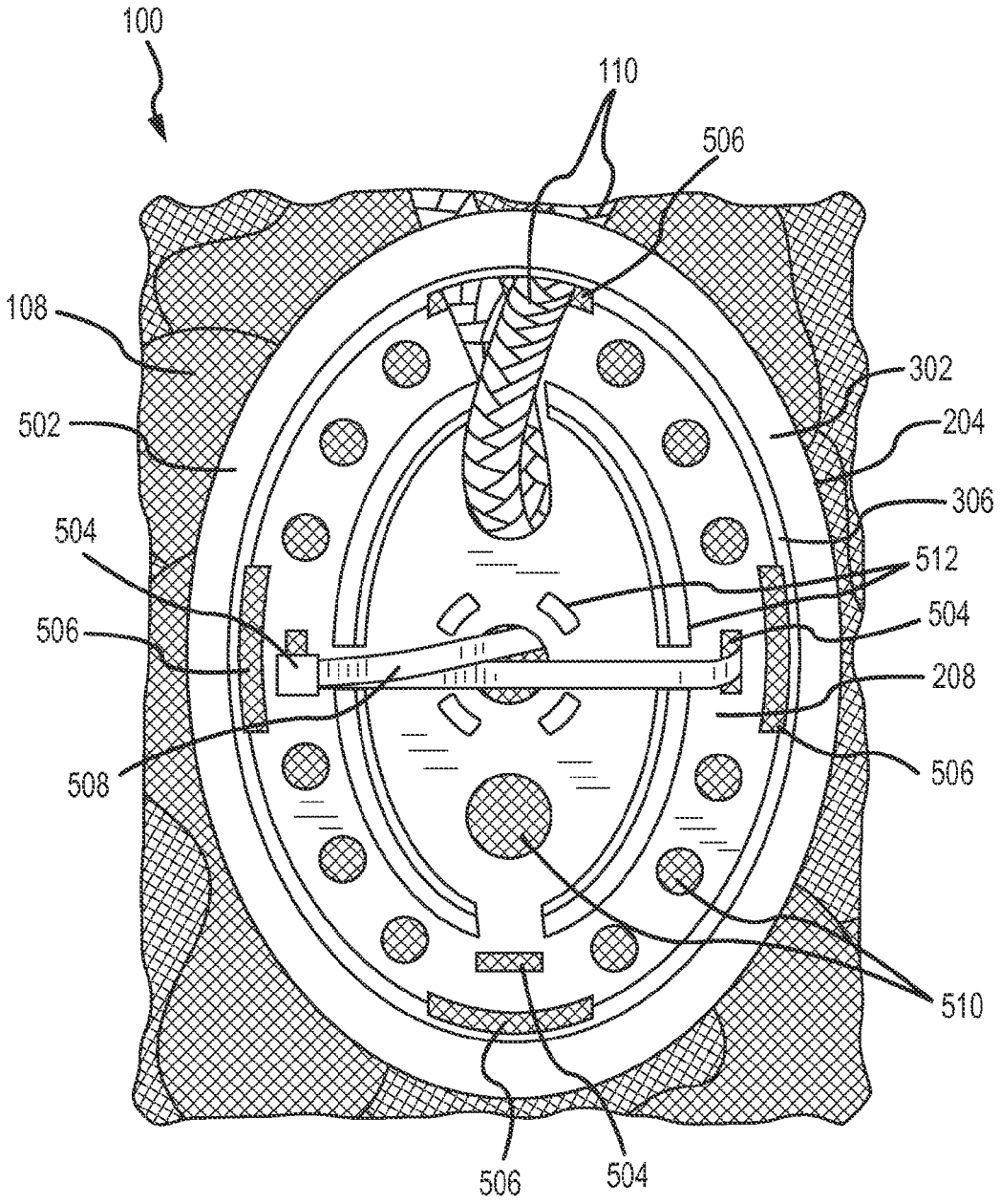
FIG. 5 depicts a top view of a bracket according to an embodiment of the application.

FIG. 5 depicts a top view of a washing device 500, including another embodiment of a bracket 502. Washing device 500 includes base scrubber 108, bracket 502, and a coupling element 508. Bracket 502 further includes narrow slots 504, wide slots 506, holes 510, and ribs 512. A scrubbing surface 104 is not shown.

The embodiment of bracket 502 includes four narrow slots 504 and four wide slots 506. Two narrow slots 504 and two wide slots 506 are positioned on the major axis of oval-shaped bracket 502; and two narrow slots 504 and two wide slots 506 are positioned on the minor axis. The narrow slots 504 and wide slots 506 are oriented to be substantially perpendicular to the respective major or minor axes that they are positioned upon. Bracket 502 further includes a plurality of holes 510 that may be positioned around bracket 502. In the example of bracket 502, holes are positioned in an oval formation symmetric to the oval formed by lip 302. Holes 510 are also positioned along the major axis of second face 208. In embodiments, bracket 502 may include any number of slots 504 and 506 or holes 510 in any configuration. Slots 504 and 506 or holes 510 may be used to couple members to bracket 506. Slots 504 and 506 may also be included to prevent the formation of defects, or to otherwise aid the fabrication of bracket 506 during the injection molding process.

In the embodiment of bracket 502, narrow slots 504 located along the minor access are used to seat coupling element 508, which couples bracket 502 to base scrubber 108. In FIG. 5, coupling element 508 is depicted as a zip tie, but those skilled in the art will recognize that a variety of fasteners may be used. For example, coupling element 508 may be a cord, a twist tie, a wire, etc.

One wide slot 506 and one hole 510 positioned along the major axis are also used to couple a handle 110 to bracket 502. In the example of FIG. 5, handle 110 is a cord which is threaded through the wide slot 506 and hole 510.

Bracket 502 further includes ribs 512, which are positioned on second face 208. Ribs 512 may provide a supportive surface or seat upon which a scrubbing surface may rest when coupled to bracket 506. Ribs 512 may also provide rigidity to bracket 502. In the embodiment of FIG. 5, ribs 512 form oval arcs symmetric to lip 302. Ribs 512 may include gaps along the minor and major axes of second face 208 that allow coupling element 508 and handle 110 to be seated against second face 208. Bracket 506 includes two sets of ribs 512 that form inner and outer ovals. The example of bracket 506 is not intended to be limiting, however. Those skilled in the art will recognize that any number of ribs 512 may be included on bracket 506.

Like bracket 106, bracket 502 includes lip 302 which substantially surrounds second face 208. Lip 302 includes inner recess 306, which meets second face 208. In an embodiment, inner recess 306 and second face 208 may serve as a seat for a scrubbing surface 104 to rest. In another embodiment, inner recess 306 and second face 208 may serve as a foundation or substrate upon which a scrubbing surface may be formed as part of a two-part injection molding process. In embodiments, a scrubbing surface may be injection molded over lip 302. In other embodiments, a scrubbing surface or may be injection molded inside of lip 302 to use less plastic and create a seamless design.

In embodiments, a scrubbing surface may removably or irremovably snap fit onto lip 302. In other embodiments, a scrubbing surface may be coupled to bracket 502 in any manner, including using adhesives known to those in the art.

Figure 6:
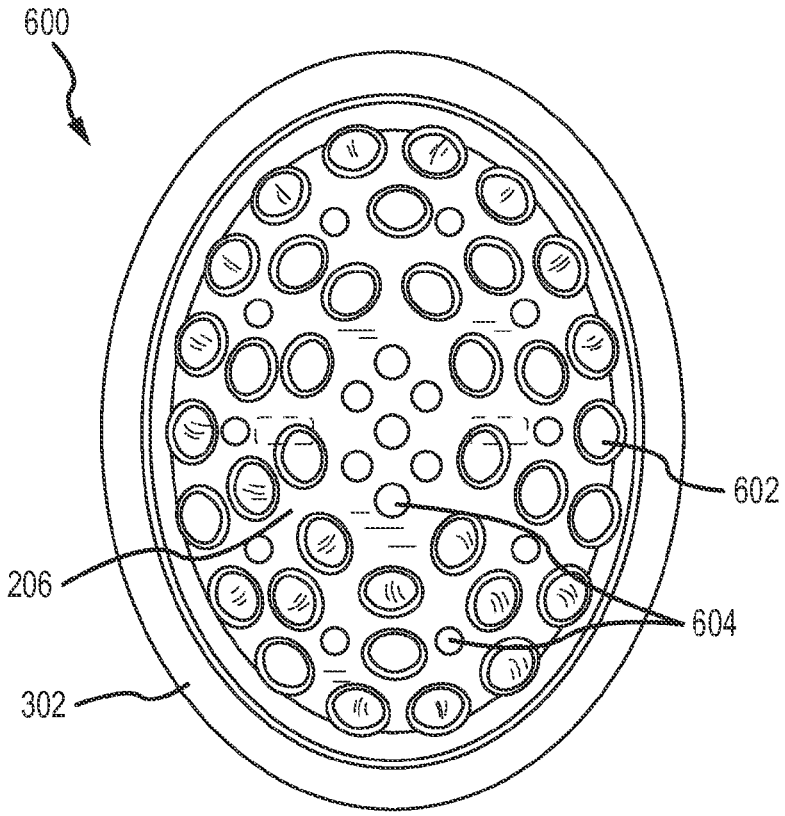
FIG. 6 depicts a top view of a scrublet according to an embodiment of the application.
Figure 7:
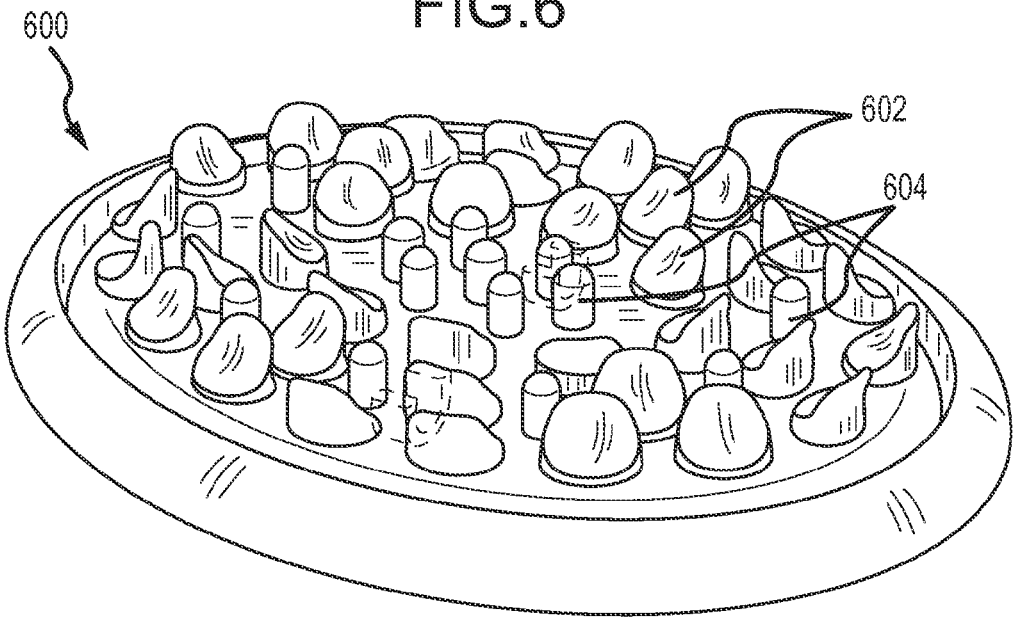
FIG. 7 depicts a perspective view of a scrublet according to an embodiment of the application.

FIGS. 6 and 7 depict a further example of a scrublet attachment 600 according to an embodiment of the application. FIG. 6 depicts a top view and FIG. 7 depicts a perspective view of a scrublet attachment 600. Scrublet attachment 600 is much like scrublet attachment 102, but instead of including fingers 202 on scrubbing surface 104, scrublet attachment 600 includes teeth 602 and knobs 604. In the embodiment of scrublet attachment 600, teeth 602 are arranged in an oval formation on first face 206, the oval formation being symmetric with lip 302. Knobs 604 are also arranged around an oval formation on first face 206, the oval formation also being symmetric with lip 302. In embodiments, teeth 602 and knobs 604 may be placed in alternating fashion around first face 206. In embodiments, any combination of protruding features may be included in any arrangement on first face 206 of scrublet attachment 102 to meet any scrubbing or washing need.

Scrubbing surface 104 and bracket 106 or 502 may be formed of the same or different materials. Scrubbing surface 104 and bracket 106 or 502 may be formed in any material known to those in the art. In an embodiment, scrubbing surface 104 may be formed in plastic via a single injection molding process and later coupled to bracket 106 or 502. Scrubbing surface 104 may also be formed directly on top of bracket 106 via a second injection molding process, or a two-step molding process. In embodiments, scrubbing surface 104 may be formed of any thermoplastic, such as a polyethylene, a polypropylene, a polystyrene, a polyvinyl chloride, or a fluoropolymer plastic, etc. In an embodiment, a thermoplastic rubber may be used. In embodiments, the plastic used to form scrubbing surface 104 may be softer than the plastic used to bracket 106 or 502. This allows bracket 106 or 502 to provide stability to scrublet attachment 102, while a softer scrubbing surface 104 may be tailored for any scrubbing or washing purpose. In an embodiment, scrubbing surface 104 may be formed out of soap.

The present application as described above provides a washing device 100 that is suitable for multiple uses. The coupling of a base scrubber 108 to a scrublet attachment 102 allows a user to combine multiple scrubbing tools into a single washing device. Further, the bracket 106 and 502 allows for a convenient way to couple the base scrubber 108 to the scrublet attachment 102. In embodiments where scrublet attachment 102 is made of soap, the need to add soap to washing device 100 is alleviated.

The detailed descriptions of the above embodiments are not exhaustive descriptions of all embodiments contemplated by the inventors to be within the scope of the application. Indeed, persons skilled in the art will recognize that certain elements of the above-described embodiments may variously be combined or eliminated to create further embodiments, and such further embodiments fall within the scope and teachings of the application. It will also be apparent to those of ordinary skill in the art that the above-described embodiments may be combined in whole or in part to create additional embodiments within the scope and teachings of the application.

Thus, although specific embodiments of, and examples for, the application are described herein for illustrative purposes, various equivalent modifications are possible within the scope of the application, as those skilled in the relevant art will recognize. The teachings provided herein can be applied to other cleaning devices, and not just to the embodiments described above and shown in the accompanying figures. Accordingly, the scope of the application should be determined from the following claims.

I claim:

1. A washing device, comprising:

a base washing member (108) comprising a base scrubber;

an attachment washing member (102) comprising a bracket portion (106, 502) permanently and irremovably affixed to a washing surface portion (104), wherein the attachment washing member (102) defines a plurality of teeth (602) and knobs (604) wherein the bracket portion comprises a lip that forms a perimeter around the bracket portion; and a coupling element (508) to temporarily and removably attach the attachment washing member (102) to the base washing member (108).

2. The washing device of claim 1, wherein the bracket portion (106, 502) and the washing surface portion (104) are each formed via an injection molding process.

3. The washing device of claim 1, wherein the bracket portion (106, 502) and the washing surface portion (104) are formed via a two-part injection molding process.

4. The washing device of claim 1, wherein the bracket portion (106, 502) is formed from a first plastic and the washing surface portion (104) is formed from a second plastic, the second plastic being softer than the first plastic.

5. The washing device of claim 1, wherein the bracket portion (106, 502) formed from one of a high impact polystyrene and a thermoplastic rubber.

6. A washing device, comprising:

a base washing member (108) comprising a base scrubber (108) permanently affixed to a bracket portion (106, 502) wherein the bracket portion comprises a lip that forms a perimeter around the bracket portion;

an attachment washing member (102) comprising a washing surface portion (104), wherein the attachment washing member (102) defines of a plurality of teeth (602) and knobs (604); and a coupling element (508) to temporarily and removably attach to the attachment washing member (102) to the base washing member (108).

7. The washing device of claim 1, wherein the washing surface portion (104) is formed from soap.

8. The washing device of claim 7, wherein the bracket portion (106, 502) is formed from soap.

9. The washing device of claim 1, wherein the bracket portion (106, 502) includes one or more eyelets (304) though which coupling element (508) threads to couple the attachment washing member (102) to the base washing member (108).

10. A method of forming a washing device including a base washing member and an attachment washing member, the attachment washing member including a bracket portion and a washing surface portion, comprising steps of:

forming the bracket portion of the attachment washing member, wherein the bracket portion comprises a lip that forms a perimeter around the bracket portion;

forming the washing surface portion of the attachment washing member, wherein the attachment washing member defines a plurality of teeth and knobs;

permanently and irremovably affixing the washing surface portion to the bracket portion; and using a coupling member to temporarily and removably attach the base washing member to the attachment washing member.

11. The method of claim 10, wherein the bracket portion is formed from a first plastic and the washing surface portion is formed from a second plastic, the second plastic being softer than the first plastic.

12. The method of claim 10, wherein the bracket portion is formed from one of thermoplastic rubber and high impact polystyrene.

13. The method of claim 10, wherein the bracket portion includes one or more eyelets though which the coupling element threads to couple the attachment washing member portion to the base washing member.

14. The method of claim 10, wherein the bracket portion and the washing surface portion are each formed by an injection molding process.

15. The method of claim 10, wherein the washing surface portion (104) is formed from soap.

* * * * *